US011866650B2

(12) United States Patent
Heeres et al.

(10) Patent No.: US 11,866,650 B2
(45) Date of Patent: Jan. 9, 2024

(54) PROCESS FOR THE PREPARATION OF LOW MOLECULAR WEIGHT AROMATICS (BTX) AND BIOFUELS FROM BIOMASS

(71) Applicant: BioBTX B.V., Groningen (NL)

(72) Inventors: André Heeres, Groningen (NL); Niels Jan Schenk, Groningen (NL); Inouk Kruize-Muizebelt, Groningen (NL)

(73) Assignee: BioBTX B.V., Groningen (NL)

( * ) Notice: Subject to any disclaimer, the term of this patent is extended or adjusted under 35 U.S.C. 154(b) by 1352 days.

(21) Appl. No.: 16/312,433

(22) PCT Filed: Jun. 23, 2017

(86) PCT No.: PCT/NL2017/050419

§ 371 (c)(1),
(2) Date: Dec. 21, 2018

(87) PCT Pub. No.: WO2017/222380

PCT Pub. Date: Dec. 28, 2017

(65) Prior Publication Data

US 2020/0181498 A1 Jun. 11, 2020

(30) Foreign Application Priority Data

Jun. 24, 2016 (NL) ..... 2017044

(51) Int. Cl.

| | |
|---|---|
| ***C10G 1/02*** | (2006.01) |
| ***C10B 57/06*** | (2006.01) |
| ***C10G 1/00*** | (2006.01) |
| ***C10G 1/08*** | (2006.01) |
| ***C10G 45/50*** | (2006.01) |

(52) U.S. Cl.

CPC ..... *C10G 1/02* (2013.01); *C10B 57/06* (2013.01); *C10G 1/002* (2013.01); *C10G 1/086* (2013.01);

(Continued)

(58) Field of Classification Search

CPC ..... C10G 1/02; C10G 1/002; C10G 1/086; C10G 45/50; C10G 2300/1011;

(Continued)

(56) References Cited

U.S. PATENT DOCUMENTS

| | | | | |
|---|---|---|---|---|
| 8,277,643 | B2 * | 10/2012 | Huber | C10G 1/002 44/605 |
| 9,169,442 | B2 * | 10/2015 | Huber | C10G 1/002 |
| 2009/0165378 | A1 * | 7/2009 | Agblevor | C10C 5/00 48/209 |

(Continued)

FOREIGN PATENT DOCUMENTS

WO WO2015047085 A1 4/2015

OTHER PUBLICATIONS

Elliott, D., "Welcome to Task 34," IEA Bioenergy, Task 34—Pyrolysis, PyNE Issue 34, Jan. 2014, pp. 1-35.

(Continued)

*Primary Examiner* — Ali Z Fadhel
(74) *Attorney, Agent, or Firm* — Verrill Dana, LLP

(57) ABSTRACT

A process for the preparation of aromatic compounds from a feed stream containing biomass or mixtures of biomass, the process comprising: a) subjecting a feed stream containing biomass or mixtures of biomass to a process to afford a conversion product comprising aromatic compounds; b) recovering the aromatic compounds from said conversion product; c) separating a higher molecular weight fraction comprising polyaromatic hydrocarbons (PAH) from a lower molecular weight fraction comprising benzene, toluene and xylene (BTX) by distillation; d) reducing at least part of said higher molecular weight fraction to obtain a reduced fraction comprising polycyclic aliphatics (PCA); and e) subjecting the higher molecular weight fraction obtained in step c), the reduced fraction obtained in step d), or a mixture thereof, to a process to obtain lower molecular weight aromatics (BTX).

20 Claims, 11 Drawing Sheets

Figure 1:
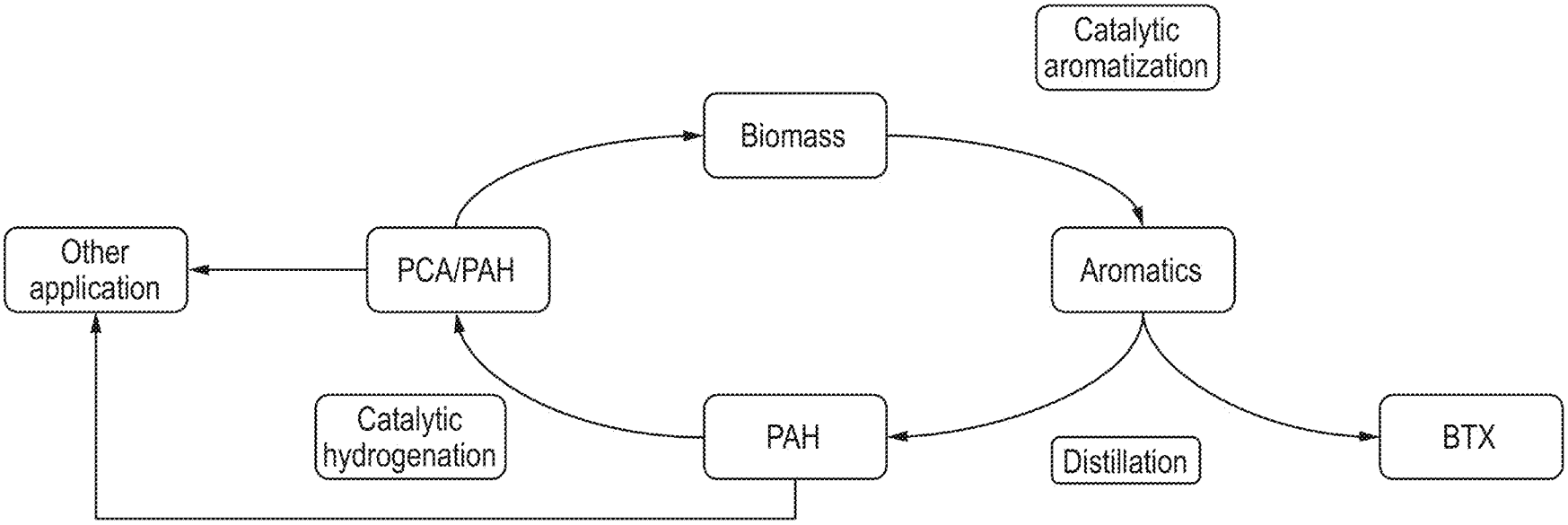

(52) U.S. Cl.
CPC ..... *C10G 45/50* (2013.01); *C10G 2300/1011* (2013.01); *C10G 2400/30* (2013.01)

(58) Field of Classification Search
CPC ..... C10G 2400/30; C10G 1/08; C10G 1/083; C10G 1/00; C10G 45/44; C10G 45/46; C10B 57/06; C10B 49/16; C10B 53/02; Y02E 50/10; Y02E 50/30; Y02P 20/145; Y02P 30/20
See application file for complete search history.

(56) References Cited

U.S. PATENT DOCUMENTS

| | | | | |
|---|---|---|---|---|
| 2009/0173666 | A1* | 7/2009 | Zhou | C10G 47/02 208/112 |
| 2013/0172639 | A1 | 7/2013 | Yanagawa et al. | |
| 2013/0267744 | A1* | 10/2013 | Kim | C10G 45/34 585/251 |
| 2014/0107306 | A1* | 4/2014 | Mazanec | C07C 5/10 562/487 |
| 2016/0002162 | A1 | 1/2016 | Tanzio et al. | |
| 2016/0326438 | A1* | 11/2016 | Sorensen | C10G 3/57 |
| 2019/0382672 | A1* | 12/2019 | Sorensen | C07C 5/10 |

OTHER PUBLICATIONS

Zhang, Y., et al., "Production of Jet and Diesel Biofuels from Renewable Lignocellulosic Biomass," Applied Energy, 2015, vol. 150, pp. 128-137.

* cited by examiner

PROCESS FOR THE PREPARATION OF LOW MOLECULAR WEIGHT AROMATICS (BTX) AND BIOFUELS FROM BIOMASS

The present invention relates to a novel process for the preparation of benzene, toluene and xylenes (BTX) and a biofuel containing higher aromatics from a feed stream comprising biomass or mixtures of biomass. It also relates to unique compositions obtainable thereby, and to the use of such compositions.

Low molecular weight monocyclic aromatic compounds such as benzene, toluene, and xylenes are important starting materials for a large number of applications. Benzene is an intermediate in, e.g., in the production of ethylbenzene, cumene, cyclohexane and adipic acid. Toluene is an intermediate for e.g., toluenediisocyanate, benzaldehyde and benzoic acid and has also found application as a solvent, e.g. for paints, printing ink and glues. From the three isomers of xylene p-xylene is often used in the preparation of para-terephthalic acid, a monomer for the preparation of several polyesters and polyamides. o-Xylene is mainly used in the production of plasticizers for PVC, m-xylene is most often converted to isophthalic acid and subsequently used in co-polymerizations with p-terephthalic acid and 3,3',4,4'-tetraaminodiphenyl.

Currently, the above-described aromatic compounds are produced via refinery processes of fossil fuels. Common processes include steam cracking, steam reforming and catalytic reforming. In order to achieve a more environmentally friendly and sustainable route, independent from the oil production, lots of academic and industrial groups focused on routes towards BTX from biomass and mixtures thereof. From the current routes described especially catalytic pyrolysis is attractive, owing to a one-step procedure and high flexibility in biomass input. Various patents and articles in the open literature describe the conversion of different biomass streams and mixtures thereof with most often zeolite-based catalysts using direct catalytic pyrolysis. In this approach the catalyst is mixed with the biomass, or an ex situ upgrading process is used in which the biomass is first (catalytically) pyrolyzed and the vapors obtained are subsequently ex situ aromatized with most often specific zeolite catalysts. In all cases a mixture of aromatics is obtained consisting of alkyl substituted mono-, bi, tri and tetracyclic aromatics. The amount of the more valuable BTX in this mixture of aromatics is dependent on process conditions and the biomass used, but most often it is the minority of the total aromatics formed. As a result, there is a strong demand for a commercially attractive process converting biomass, or mixtures thereof, in high yields towards the more valuable compounds benzene, toluene and xylenes (BTX).

It was surprisingly found that a unique high molecular weight fraction comprising polyaromatic hydrocarbons (PAH), polycyclic aliphatics (PCA), mono-aromatic polycyclic hydrocarbons (MPH), or mixtures thereof, can be isolated during and/or after the biomass conversion process, and that the co-feeding of said fraction with a biomass feedstream greatly increases the yield of BTX.

Accordingly, in one aspect the present invention provides a process for the preparation of aromatic compounds from a feed stream containing biomass or mixtures of biomass, the process comprising:

a) subjecting the biomass feed stream to a process to afford a conversion product comprising aromatic compounds; b) recovering the aromatic compounds from said conversion product; c) separating a higher molecular weight fraction comprising polyaromatic hydrocarbons (PAH) from a lower molecular weight fraction comprising benzene, toluene and xylene (BTX) by distillation; d) reducing at least part of said higher molecular weight fraction to obtain a reduced fraction comprising polycyclic aliphatics (PCA); and e) subjecting the higher molecular weight fraction obtained in step c), the reduced fraction obtained in step d), or a mixture thereof, to a process to obtain lower molecular weight aromatics (e.g. BTX).

In one embodiment step a) of a process according to the invention comprises subjecting the biomass feed stream to in situ or ex situ pyrolysis, or to a vaporization process. Preferably, subjecting the biomass feed stream to a process to afford a conversion product comprises pyrolysis of the biomass feed, preferably using a cheap cracking catalyst, followed by subsequently subjecting the vapors thus obtained to an ex situ catalytic aromatization step.

In step b), the aromatic compounds are recovered from the conversion product of step a), after which in step c) a unique higher molecular weight fraction comprising polyaromatic hydrocarbons (PAH) is separated from a lower molecular weight fraction comprising benzene, toluene and xylene (BTX) by distillation.

As will be described herein below, the polyaromatic hydrocarbon fraction, obtained after the distillation of BTX, can subsequently be (re)-utilized in the pyrolysis, thereby affording a mixture of BTX and higher aromatics. More in particular, at least part of the polyaromatic fraction obtained after distillation of BTX is first reduced (e.g., by catalytic hydrogenation) in step d) towards polycyclic aliphatics (PCA), polyaromatic hydrocarbons (PAH), mono-aromatic polycyclic hydrocarbons (MPH, e.g. substituted tetralins) or a mixture of PCA, PHA and/or MPH, preferably PCA/PAH, and thereafter (re)-utilized in the pyrolysis.

In step e) the higher molecular weight fraction obtained in step c), the reduced fraction obtained in step d), or a mixture thereof, is subjected to a process to obtain lower molecular weight aromatics (e.g. BTX).

Figure 2:
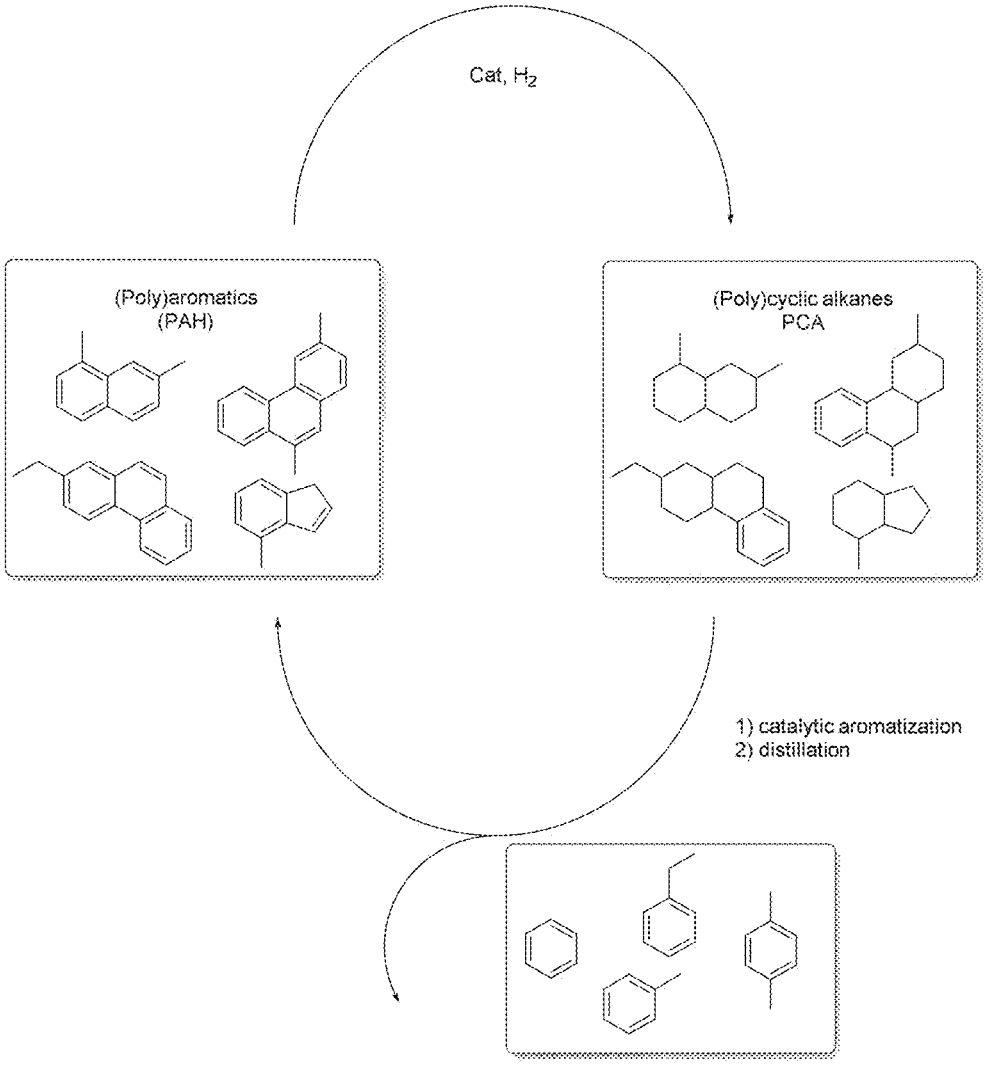

In one embodiment, the above described high molecular weight fractions (partially or fully reduced or not) are co-feeded with a biomass or mixtures thereof, thereby resulting in significant higher yields of BTX. The BTX can easily be distilled and the remaining higher aromatic fraction can again be utilized in the pyrolysis or, alternatively, first reduced to an aliphatic/aromatic fraction and re-utilized in the pyrolysis step. The above-described process is depicted in FIGS. 1 and 2. Repeating the above-described procedure will result in high conversions of biomass towards BTX.

Figure 3:
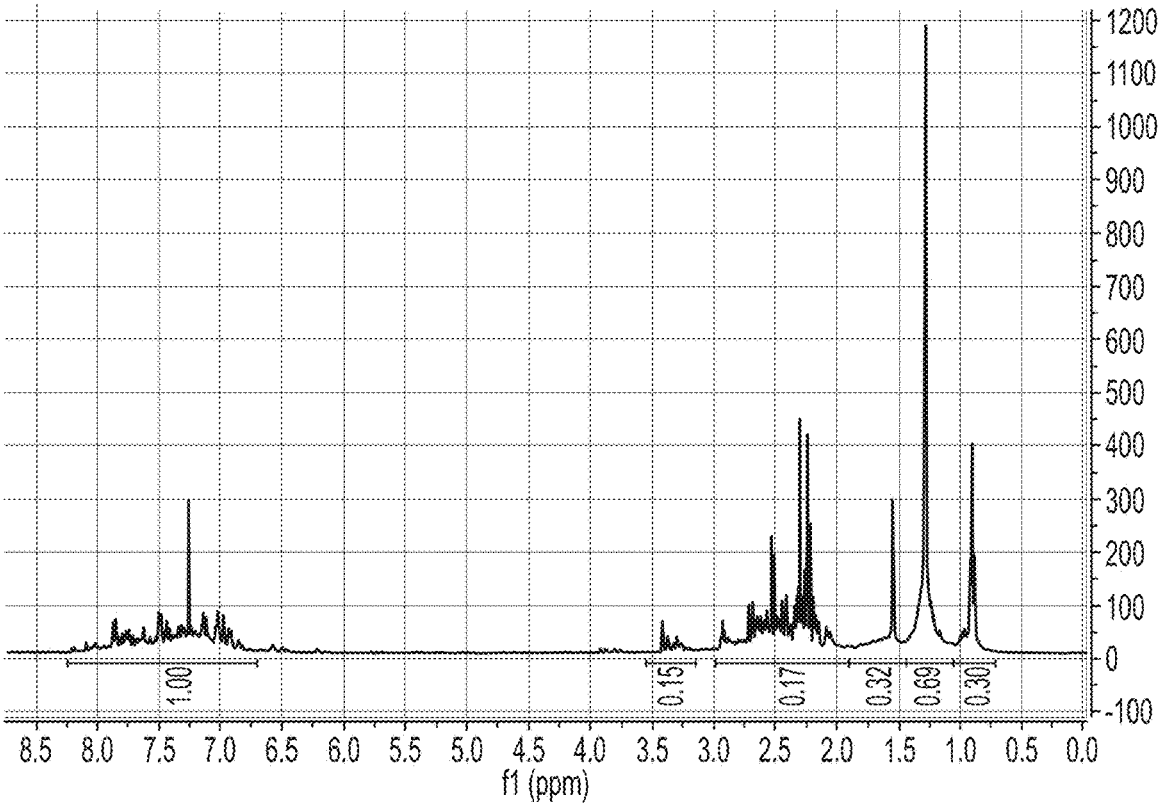
Figure 4:
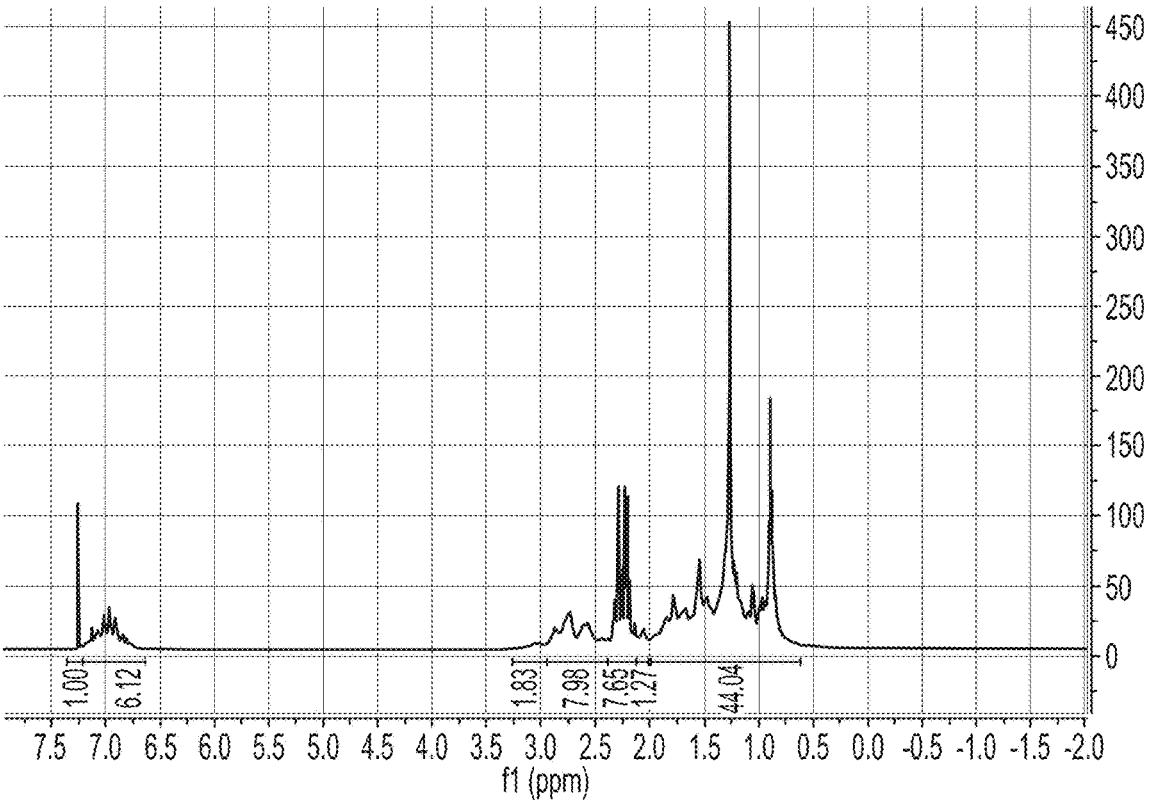
Figure 6:
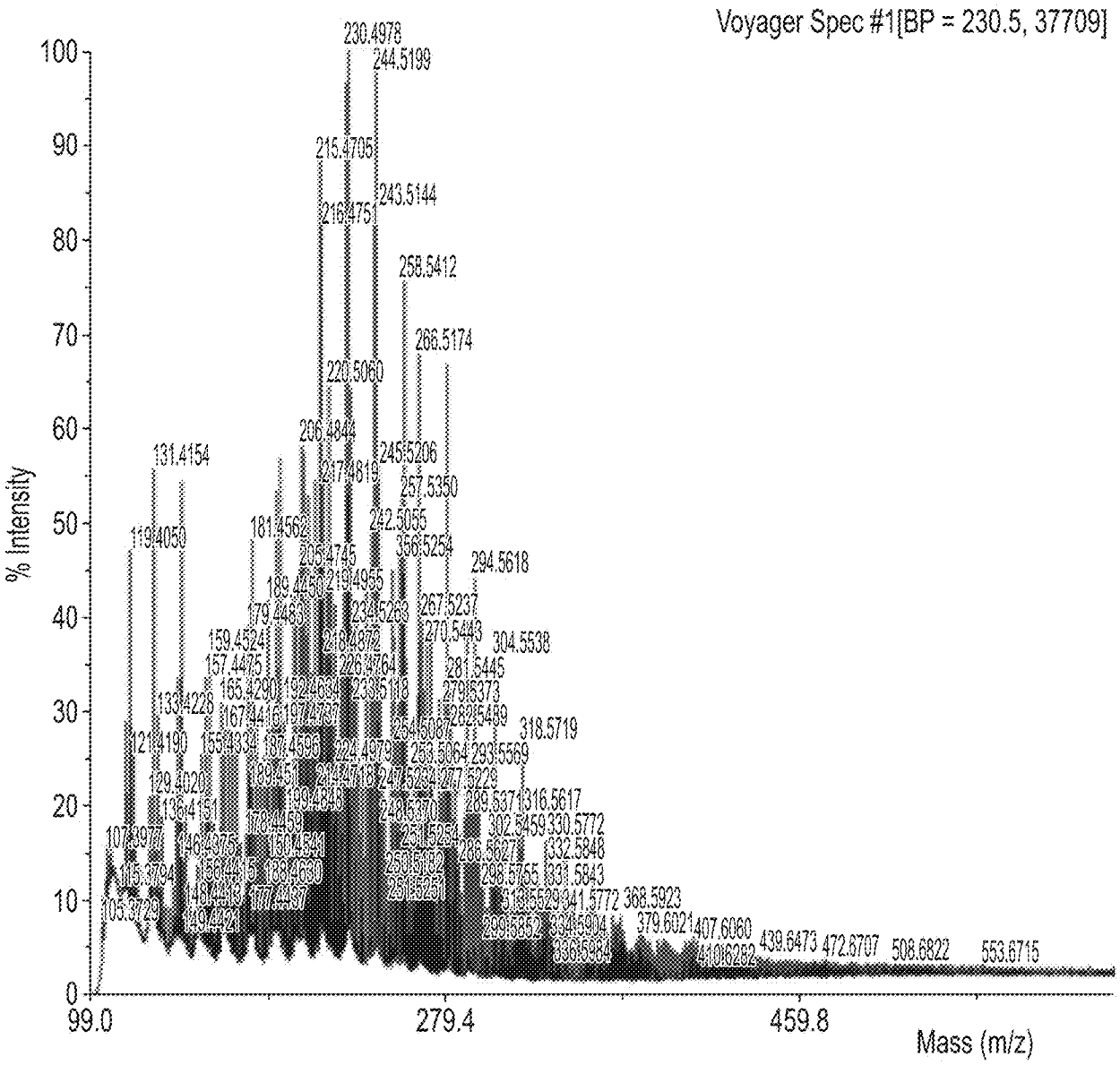
Figure 7:
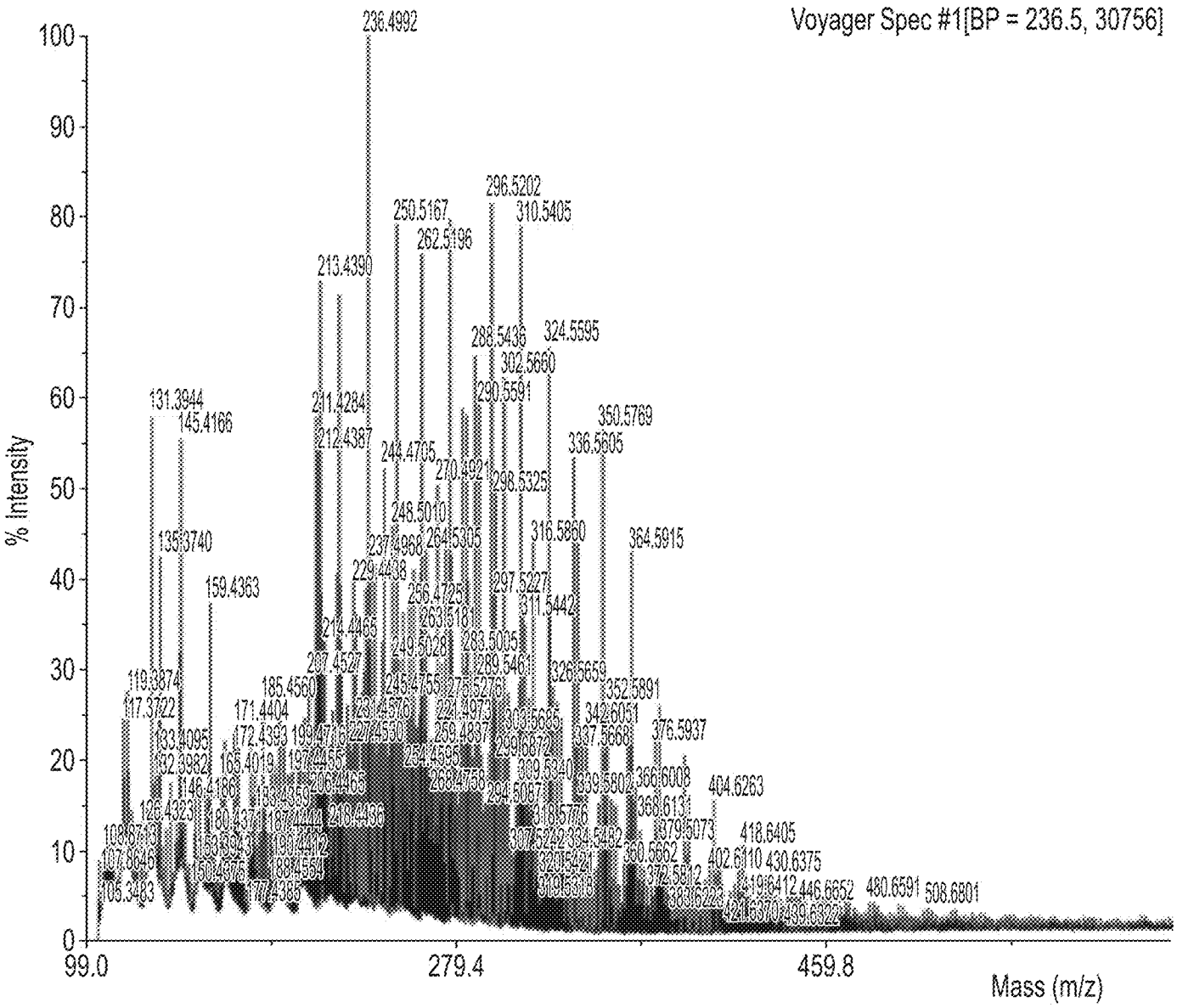

FIGS. 3 and 4 show, respectively, the $^{1}$H-NMR spectra of the polyaromatic fraction and the $^{1}$H-NMR of the reduced fraction, obtained by catalytic hydrogenation. It clearly shows that the amount of aromatic protons present between 6.5-8.0 ppm are less in intensity and mostly converted to aliphatic hydrocarbons. The conversion of the polyaromatic fraction towards aliphatics is confirmed by GC analysis (see FIG. 5) and Matrix-assisted laser desorption/ionization time-of-flight (MALDI-TOF) measurements (FIGS. 6 and 7). In the present invention, the initial aromatic fraction in step a) may be obtained via catalytic pyrolysis of hydrocarbonaceous material. It will be understood that the composition of the vaporous fraction to some extent depends on the nature of the feed stream and the conditions applied. It has been found that good results are obtained with feed streams comprising biomass selected from the group consisting of agricultural waste, plants, wood, and combinations thereof. The feed stream suitably comprises organic material such as, glucose, maltose, starch, cellobiose, cellulose, hemi-cellulose, other polysaccharides, lignin, sugar cane bagasse, lignocellulosic materials (e.g., wood chips or shavings, lignocellulosic biomass, etc.), glycerol, fatty acids, fatty acid methyl esters, triglycerides, food waste, animal waste, manure and corn stover. Also partially decayed vegetation, such as peat or even lignite can be used as biomass feed material in the process of the present invention. The feed stream preferably comprises crude glycerol and/or triglycerides The resulting aromatic fraction from the above-described feed streams can be separated from aqueous condensables, as phase separation occurs. After distillation of BTX, the higher substituted aromatics fraction can be re-utilized in the pyrolysis step or subsequently be reduced to a polycyclic alkanes or mixtures of polycyclic alkanes/polyaromatic hydrocarbon/mono-aromatic polycyclic hydrocarbons. The hydrogenation can be complete, resulting in a fraction consisting of polycyclic aliphatics (PCA). Typically, it is not complete in the sense that not all polyaromatic molecules are reduced and/or in that not all aromatic rings of a single polyaromatic molecule are reduced. In that case, the reduced fraction may comprise, in addition to polycyclic aliphatics (PCA), also polyaromatic hydrocarbons (PAH) and/or mono-aromatic polycyclic hydrocarbons (MPH, e.g. substituted tetralins). This mixture can be catalytically pyrolyzed towards BTX/aromatics or co-feeded with the above-described feed streams in order to produce BTX/aromatics.

In the present invention the aromatics can be formed by a pyrolysis reaction of biomass with a catalyst, a pyrolysis of a mix of biomass with a polyaromatic hydrocarbon fraction and a catalyst, a mixed polycyclic alkanes/polyaromatic hydrocarbon fraction or a polycyclic alkane fraction and a catalyst. It is well known that a variety of pyrolysis techniques are able to produce such a fraction from biomass feed (G. W. Huber, S. Iborra, A. Corma, Chem. Rev., 2006, 4044-4098). A particularly desirable form is catalytic fast pyrolysis and this involves the rapid heating of a biomass feed stream under an inert atmosphere in the presence of a catalyst (A. V. Bridgwater, Cat Today, 1996, 285-295; A. J. Forster, J. Jae, Y. T. Ching, G. W. Huber, R. F. Lobo, Appl. Cat. A: General., 2012, 154-161 and G. W. Huber, H. Zhang, T. Carlson, WO2013/032672). The pyrolysis can be performed in situ, in which the catalyst is mixed with the biomass and pyrolysed thereafter or, alternatively, ex-situ in which the biomass is non-catalytically pyrolyzed and in a second reactor catalytically transformed towards a mixture of aromatics. Within our invention the biomass can be co-feeded with the polyaromatic hydrocarbon fraction or the polycyclic alkanes/polyaromatic hydrocarbon/mono-aromatic polycyclic hydrocarbon fraction in order to increase the amount of BTX.

Figure 8:
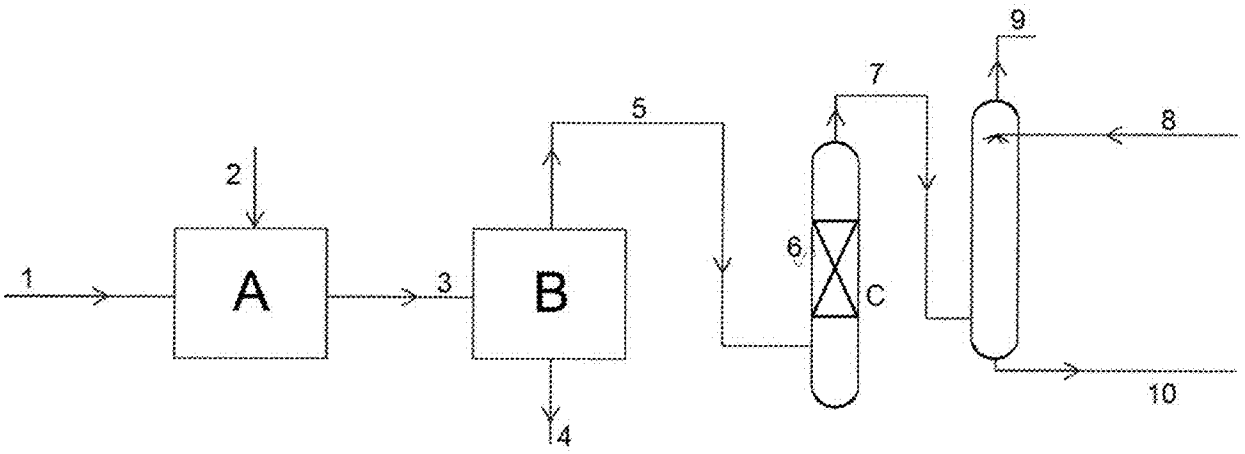

In a highly preferred embodiment, a method is used in which a cheap cracking catalyst is utilized in the pyrolysis step, followed by an ex situ catalytic aromatization step (Integrated Cascading Catalytic Pyrolysis). The latter method has the advantage that the aromatization catalyst will not be contaminated with inorganic material present in biomass and the cheap cracking catalyst influences both the yield and the composition of the vaporous fraction and allows thus the skilled person to produce significantly higher amounts of aromatics in the subsequent aromatization step (FIG. 8; see also WO 2015/047085 A1). Within our invention the biomass can also in this case be co-feeded with the polyaromatic hydrocarbon fraction or the polycyclic alkanes/polyaromatic hydrocarbon fraction in order to increase the amount of BTX.

Referring to FIG. 8, a feed stream containing biomass, or a mixture of biomass, mixtures of biomass, or a mixture of biomass and a polycyclic alkanes/polyaromatic fraction or a polycyclic alkanes/polyaromatic fraction/mono-aromatic polycyclic hydrocarbons or a polycyclic alkane fraction is passed into a pyrolysis reactor A. To the reactor A also a stream of cracking catalyst is passed via a line 2. In the pyrolysis reactor A the cracking catalyst and feed stream are contacted with each other at pyrolysis conditions to yield a vaporous phase and a solid phase which consists of the cracking catalyst with coke residues deposited thereon. After the reaction the vaporous fraction is passed via a line 3 to reactor B. The coke-laden cracking catalyst may be recycled to the reactor A. It may also be subjected to regeneration by burning off of the coke from the cracking catalyst. It may also be used as landfill, e.g. after removal of the coke.

In reactor B the vapor phase from reactor A is converted by a catalyst into aromatic compounds. The conversion product leaves the reactor B as a vapor via a line 7. Although reactor B has been depicted as a fixed-bed reactor it is emphasized that also a moving bed reactor, fluid bed reactor, or circulating fluid bed reactor is feasible. In either case zeolitic aromatization catalyst may be removed from the reactor B. The conversion product is subsequently passed into an extraction column C where it is contacted with a liquid hydrocarbon stream that is sprayed into the column C via a line 8 that is provided with a nozzle or manifold. Due to the contact with the liquid hydrocarbon, the aromatic compounds in the conversion product condense and are withdrawn, together with other liquids, e.g. liquid oxygen-containing compounds, via a line 10. Any residual gases are discharged via a line 9 for further treatment and disposal (not shown). The liquid aromatic products, liquid hydrocarbon and liquid oxygen-containing compounds in the line 10 are separated from each other, e.g. by phase extraction and/or fractionation (not shown). The BTX part of the aromatic fraction is distilled and, if preferred, the remaining higher aromatics reduced (partly) to polycyclic alkanes and re-utilized as co-feeding for reactor A.

The pyrolysis treatment of the feedstock may be carried out in a variety of reactors. Such reactors include a continuous stirred tank reactor (CSTR), a fixed bed reactor, a moving bed reactor, an auger reactor, a screw conveyor reactor, an entrained flow reactor, a rotating cone reactor and a fluidized bed reactor. Since the cracking catalyst tends to receive deposits of coke and other carbon residues it is preferred to employ a reactor that allows easy, and preferably continuous, regeneration. Therefore, the use of a CSTR, moving bed, an auger reactor, a screw conveyor reactor, an entrained flow reactor, a rotating cone reactor or fluidized bed reactor is preferred over the use of a fixed-bed reactor. Reactors that allow for a relatively short contact time and for intense mixing of the components of the feed stream with the cracking catalyst and for a continuous recirculation of regenerated catalyst to the pyrolysis zone are most preferred. Since this is the case for an auger reactor and a fluidized bed reactor, these reactors are particularly preferred.

Preferably, the aromatization catalyst is a zeolitic catalyst, suitably selected from aluminosilicates, SAPOs, silicalites and combinations thereof. It has been found that the second, aromatization catalyst preferably is acidic. The acidity may be influenced by the structure of the aluminosilicate and also by the ratio between silicate moieties and aluminate moieties in the aluminosilicate. The acidity may e.g. be accomplished by ion exchange of the second, aromatization catalyst with ammonium salts and subsequent calcination thereof. The silica-alumina ratio (SAR) is relevant for the potential acidity of the second catalyst. At a low SAR and if virtually all the active sites have been rendered in the $H^+$ form, the resulting catalyst is very acidic. It will be evident that the acidic sites on the aluminosilicates and the variation in SAR will enable the skilled person to determine what catalyst performs optimally for the relevant feed streams, reaction conditions and product slate. Suitable SARs include those in the range of 5 to 100, preferably, from 10 to 80, more preferably from 20 to 60. Another feature that may play a role in the performance of the present catalyst is the pore diameter. It has been found that particularly good results are obtained if the pore diameter of the catalysts is in the range of 4.5 to 6.5 Å, preferably from 5 to 6 Å. Although the second catalyst may be a SAPO, the second catalyst is preferably a zeolite, that is selected from the group consisting of ZSM-5, ZSM-11, ZSM-35, ZSM-23, ferrierite, zeolite beta, zeolite Y, zeolite X, mordenite, zeolite A, IM-5, SSZ-20, SSZ-55, MCM-22, TNU-9 and combinations thereof. In a preferred embodiment, use is made of a zeolite catalyst which has been impregnated with metals such as Ga and Zn in order to increase the yield of BTX. Combinations of catalysts can be mixed homogeneously or layered. It is not restricted to combinations of zeolite catalysts but also combinations of a zeolite catalysts with e.g. a cracking catalysts are encompassed.

As indicated above, the acidity of the second, aromatization catalyst plays a role in the conversion of the vaporous fraction. The acidity may be related to the silica alumina ratio of the catalyst when the second, aromatization catalyst is a zeolitic catalyst. When the catalyst is a zeolitic catalyst also the pore size of the zeolite catalyst is a factor in the process according to the present invention. Preferred pore diameters are those above. A preferred catalyst comprises a H-ZSM-5 zeolite with a silica-alumina ratio in the range of 15 to 100, preferably of about 20-60, since such H-ZSM-5 is most optimal for production of aromatics.

The conversion treatment is suitably carried out at a temperature in the range of 300 to 1000° C. Relatively high temperatures, such as 450 to 650° C. are preferred since they tend to increase the formation of aromatic compounds from the vaporous phase. The pressure suitably ranges from 1 to 4 bar. In the conversion treatment the catalyst is suitably present in a weight ratio of feed to catalyst in the range of 1:1 to 1:20.

Another preferred method for increasing the yield on aromatic compounds is constituted by the addition of one or more further reactants to the conversion treatment in step a) of a process of the invention. Such further reactant(s) can suitably be selected from the groups consisting of extra olefins, alcohols, aldehydes, ketones, acids and combinations thereof. The further reactant suitably comprises from 1 to 6 carbon atoms. Examples of suitable further reactants include hydrogen, ethene, propene, butene, isobutene, pentenes and hexenes, methanol, ethanol, propanol or isopropanol and hexanol, formaldehyde and acetaldehyde, acetone, methyl ethyl ketone, formic acid and acetic acid.

The vaporous phase, obtained after the aromatization process, is condensed to separate the extraction products into a gaseous and liquid fraction. The condenser may be a series of condensers well known in the art, but a suitable method for recovering the aromatic compounds from the conversion product is constituted by a method wherein the conversion product is passed into an extraction column. A liquid hydrocarbon is sprayed into the conversion product thereby cooling the conversion product and providing a solvent for the aromatic compounds. Oxygen-containing compounds, including water that may be formed during the process, easily separate from the mixture of conversion product and liquid hydrocarbon. In this way the aromatic hydrocarbons are recovered together with the liquid hydrocarbon.

The liquid phase is separated in an aqueous phase and an organic phase, containing the apolar aromatics. The organic fraction is subsequently distilled under atmospheric or slightly reduced pressure to distill off the high value aromatics benzene, toluene, xylenes and ethylbenzene. The remaining polyaromatic hydrocarbon fraction consist of highly substituted single and multiple aromatic rings aromatics (C9-≈C20) with an molecular weight between about 120-500 D. For some embodiments this polyaromatic fraction is used as a biofuel or utilized as an additive for conventional fuels. In another embodiment, the polyaromatic hydrocarbon obtained could be used as the spraying solvent in condensing the vaporous phases obtained in the catalytic aromatization process.

Step d) of a process herein disclosed comprises reducing at least part of said higher molecular weight fraction to obtain a reduced fraction comprising polycyclic aliphatics (PCA). For example, the above-described polyaromatic hydrocarbon fraction can easily be converted to a mixture of polycyclic and polyaromatic hydrocarbons by reduction. For example, liquid phase catalytic hydrogenation affords, depending on the reaction conditions, a mixture of substituted aliphatic cycloalkanes/aromatic hydrocarbons. Suitable catalytic systems and reaction conditions to achieve the desired conversion are described in the open literature (A. Stanislaus, B. H. Cooper, Catal. Rev. Sci. Eng., 1994, 75-123). Accordingly, in a preferred aspect, step d) comprises catalytic hydrogenation, preferably using a catalyst selected from the group consisting of Ru/C, Ni/C, Pd/C, Pt/C, $MoS_2$, $WS_2$, Co—Mo—S/$Al_2O_3$, Ni—Mo—S/$Al_2O_3$, Ni—W—S/$Al_2O_3$, Co—Mo/$Al_2O_3$ or homogeneous catalysts such as the Wilkinson catalyst and the Crabtree catalyst.

Preferably, the catalytic hydrogenation is performed without the addition of any other solvent. Owing to the robust ring strain, low freezing points and high heat of combustions this fraction can be utilized as high-value biofuel for e.g., jet fuels.

In another embodiment, a selective catalytic hydrogenation towards mono-aromatic polyclic alkanes is performed (Y. Cheng et al. Green Chem. (2009) 11, 1061-0165 and Y. Chen et al. Chem Cat Chem., (2015) 7, 978-998).

In step e) of a process according to the invention, the higher molecular weight fraction obtained in step c), the reduced fraction obtained in step d), or a mixture thereof, is subjected to a process for obtaining lower molecular weight aromatics (BTX). In one embodiment, step e) comprises mixing the higher molecular weight fraction obtained in step c), the reduced fraction obtained in step d), or a mixture thereof, with a biomass feedstream and subjecting the resulting mixture to pyrolysis or vaporisation. Preferably, the process of step e) to obtain lower molecular weight aromatics comprises a catalytic pyrolysis treatment. In a specific aspect, a process of the invention mixing the higher molecular weight fraction obtained in step c), the reduced fraction obtained in step d), or a mixture thereof, with the biomass feedstream of step a), thus yielding a recycling process.

Further aspects of the invention relate to unique compositions obtainable by some or all of the method steps of a process herein disclosed, and to the uses of such compositions. In one embodiment, the invention provides a composition comprising higher molecular weight polyaromatic hydrocarbons (PAH) obtainable by steps a) through c) of a method described herein above. In another embodiment, the invention provides a composition comprising higher molecular weight polycyclic aliphatics (PCA) obtainable by steps a) through d) of a method of the invention. Also provided is a composition comprising a mixture of polycyclic aliphatics (PCA), polyaromatic hydrocarbons (PAH) and/or mono-aromatic polycyclic hydrocarbons (MPH)

A composition of the invention typically comprises compounds having a molecular weight in the range of about 100 to 500 Dalton, preferably about 120 to 300 Dalton. In one aspect, the composition comprises compounds having about 9 to 20 C-atoms and single or multiple c rings. Since a method of the invention comprises a (distillation) step to separate a higher molecular weight fraction comprising polyaromatic hydrocarbons (PAH) from a lower molecular weight fraction comprising benzene, toluene and xylene (BTX), a composition provided by the invention typically contains a very small amount, e.g. less than about 10%, preferably less than about 5% by weigh, of monocyclic compounds. This is distinct from compositions known in the art, for example by Zhang et al. (2015, Applied Energy, part 150, pp. 128-137). Therein, the production of C8-C15 cyclic alkanes for jet fuels is described via alkylation of low-carbon aromatic monomers obtained from lignocellulose biomass. In contrast to the present invention, the compositions of Zhang mainly consist of (about 80 wt %) alkylated monocyclic structures having an average carbon number of 11.5.

A composition comprising higher molecular weight PAH, PCA, MPH or mixture thereof finds various uses and applications. For example, a composition comprising higher molecular weight PAH obtainable by steps a) through c) is advantageously used as a biofuel.

A composition comprising higher molecular weight polycyclic aliphatics (PCA) obtainable by steps a) through d) also has many interesting applications, for example as a jet fuel additive or in a petrochemical process, preferably a process involving a naphtha cracker or a steam reformer. See also FIG. 1.

The invention is further illustrated by means of the attached drawings and Examples.

LEGEND TO THE FIGURES

FIG. 1 is a flow diagram of an embodiment of the method according to the invention for improving the yield of BTX from biomass. The aromatic fraction obtained in the catalytic aromatization treatment is subjected to distillation in order to separate the BTX fraction from a high molecular weight polyaromatic hydrocarbon (PAH) fraction. At least part of the latter fraction is first reduced to a polycyclic aliphatic fraction, which can be co-feeded with the biomass in order to achieve a recycling of higher aromatics towards BTX. Alternatively, the high molecular weight fraction (reduced or not) is used for other applications.

FIG. 2 displays the chemistry for the preparation of additional BTX from a polyaromatic fraction by reduction/hydrogenation and subsequent catalytic aromatization.

FIGS. 3 and 4 show the $^{1}$H-NMR of the polyaromatic fraction and the $^{1}$H-NMR of the reduced fraction, obtained by catalytic hydrogenation (ex situ upgrading) of glycerol (PAH-1). It clearly displays that the amount of aromatic protons present between 6.5-8.0 ppm are less in intensity and mostly converted to aliphatic (cyclic) hydrocarbons.

Figure 5:
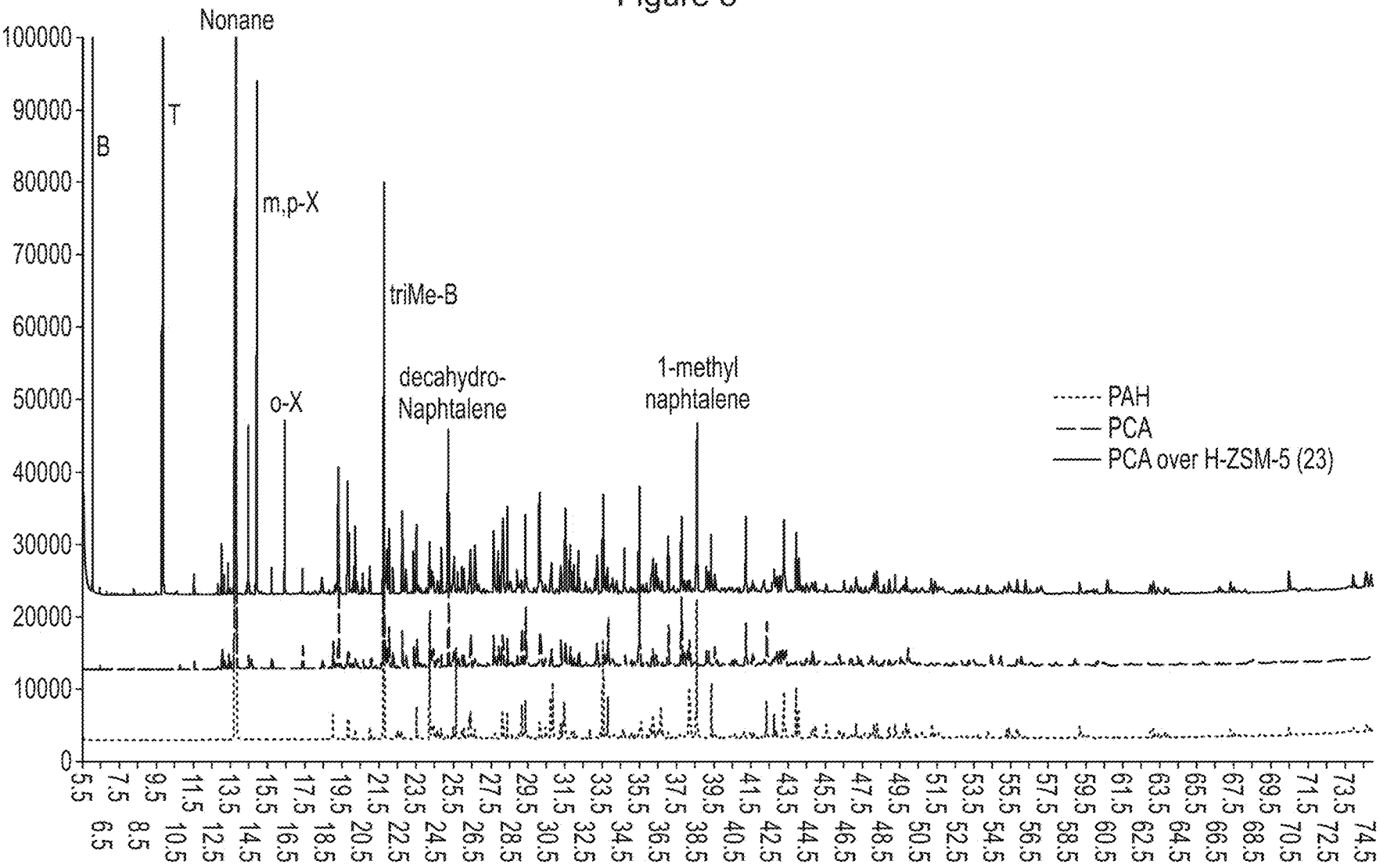

FIG. 5 GC Chromatograms of polyaromatic hydrocarbons (from glycerol), polycyclic alkanes/polyaromatic hydrocarbons (PCA/PAH-1), obtained by catalytic hydrogenation (Ru/C) and PCA/PAH-1 aromatized over an H-ZSM-5 (23) catalyst. It is observed that the PCA/PHA fraction is converted by the catalyst toward a mixture of BTX and higher aromatics.

FIG. 6 and FIG. 7 display the MALDI-TOF spectra of the polyaromatic fraction and the reduced fraction and confirm the transformation of aromatics towards aliphatics.

FIG. 8 is a flow diagram of an embodiment of the method according to the Integrated Cascading Catalytic Pyrolysis (N. J. Schenk, A. Biesbroek, A. Heeres, H. J. Heeres, WO 2015/047085 A1).

Figure 9:
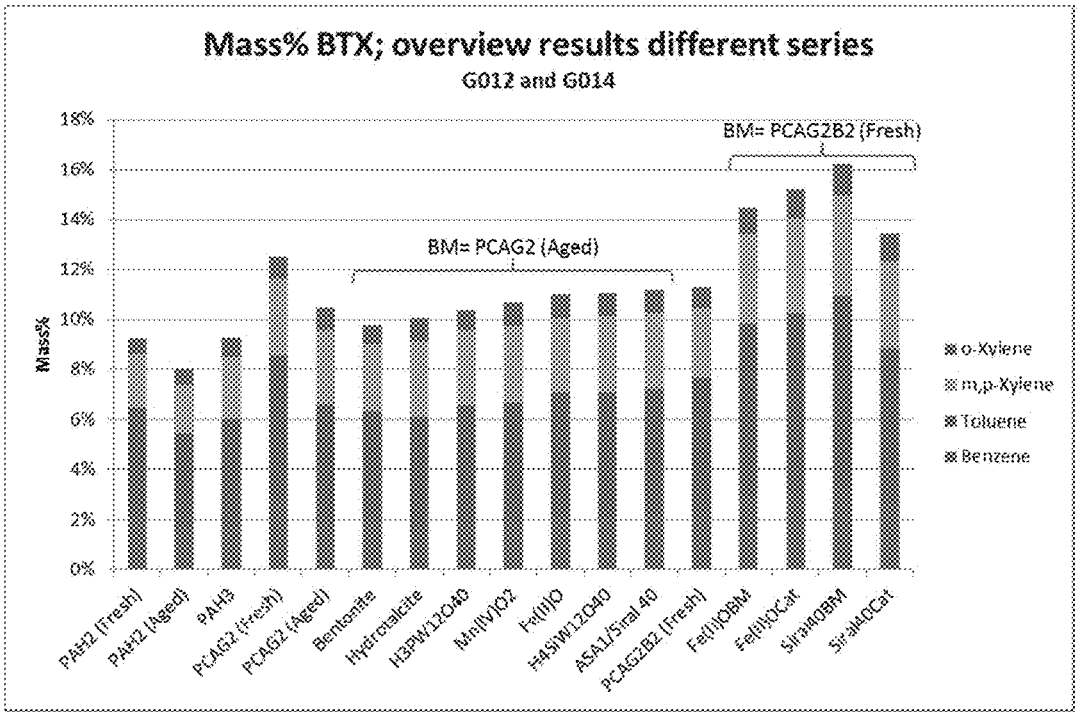

FIG. 9 Ex situ pyrolysis of polyaromatic hydrocarbons (PAH-2, obtained from glycerol, after distillation of BTX)), polycyclic alkanes/polyaromatic hydrocarbons (PCAG2; obtained by catalytic hydrogenation (Ru/C) of PAH-2) (((T=560 C, H-ZSM-5 (23), zeolite:biomass 3:1) and an Integrated Cascading Catalytic Pyrolysis Process of PCAG-2 with different cracking catalysts ((T=560 C, H-ZSM-5 (23), zeolite:biomass 3:1, cracking catalyst:biomass=0.5-1.0:1), yields of BTX (see examples 6-19)

It can be concluded that

- the reduced polycyclic and polyaromatic hydrocarbon fraction afford higher yields of BTX as compared to the non-reduced polyaromatic fraction
- both the PAH and PCA fraction suffer from ageing and lowers yields of BTX were obtained if both fractions were stored for several months at room temperature.
- under the conditions used the Integrated Cascading Catalytic Pyrolysis, using a cracking catalyst afforded higher amounts of BTX for fresh produced PCA.
- an ex situ pyrolysis of a fresh PCA fraction with a mix of a cracking catalyst and a aromatization catalyst (H-ZSM-5 (23) (layered) results in higher formation of BTX.

Figure 10:
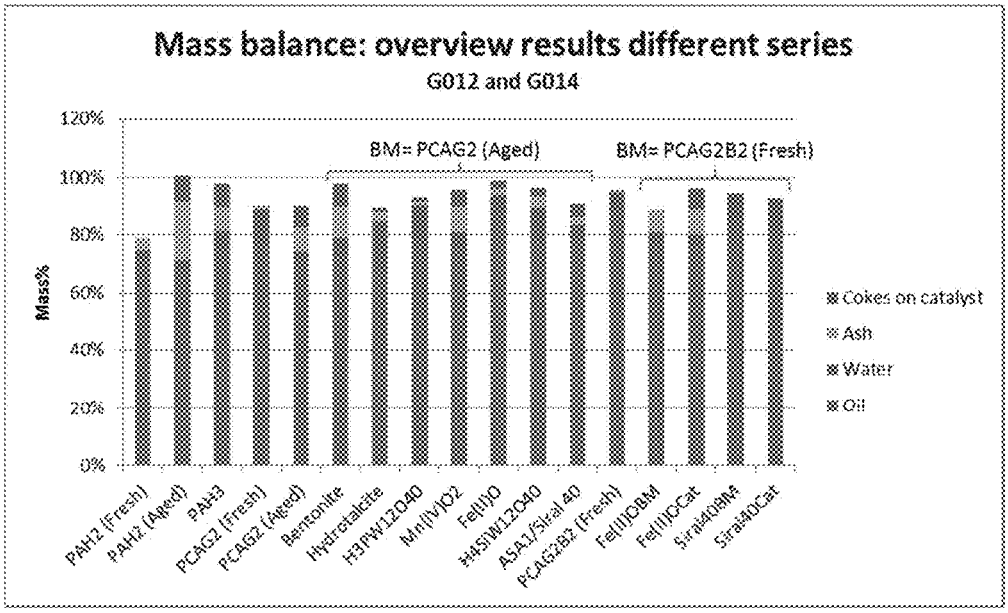

FIG. 10. Mass balances for the ex situ pyrolysis of polyaromatic hydrocarbons (PAH-2, obtained from glycerol, after distillation of BTX)), polycyclic alkanes/polyaromatic hydrocarbons (PCAG2; obtained by catalytic hydrogenation (Ru/C) of PAH-2)(((T=560 C, H-ZSM-5 (23), zeolite:biomass 3:1) and an Integrated Cascading Catalytic Pyrolysis Process of PCAG-2 with different cracking catalysts ((T=560 C, H-ZSM-5 (23), zeolite:biomass 3:1, cracking catalyst:biomass=0.5-1.0:1 (see examples 6-19).

It can be concluded that minor amounts of char, gas and water are being formed and the majority of the PAH and PCA is transformed into a bio-oil, consisting of BTX and substituted higher aromatics (GC). The bio-oil obtained can be subjected to distillation in order to isolate BTX and the remaining fraction can be reutilized in the pyrolysis treatment.

Figure 11:
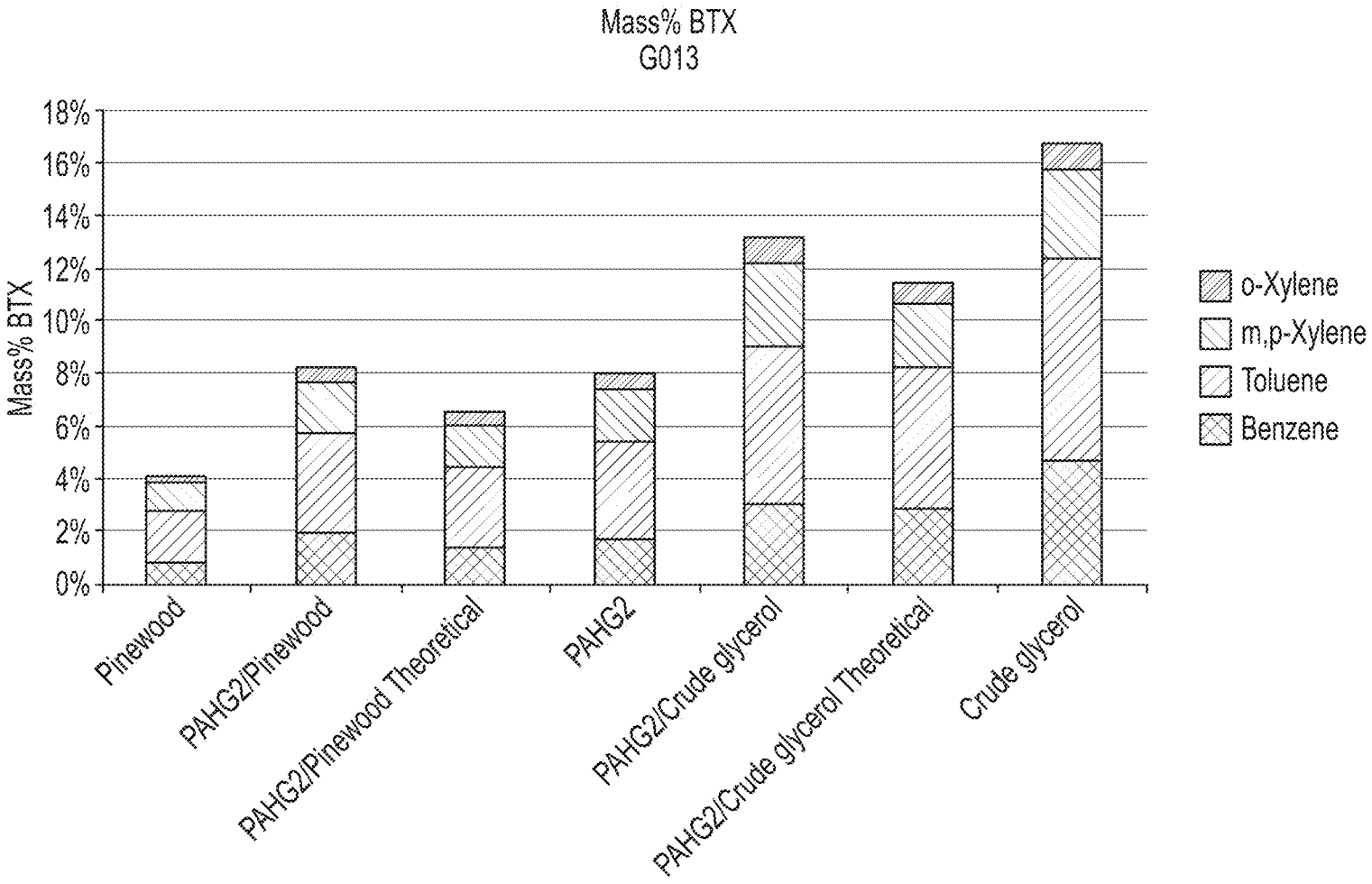

FIG. 11. displays the BTX yields of the ex-situ pyrolysis of several biomass feedstocks co-feeded with a polyaromatic hydrocarbon fraction (PAH-2, obtained from glycerol) (see examples 1, 6 and 20-22).

Figure 12:
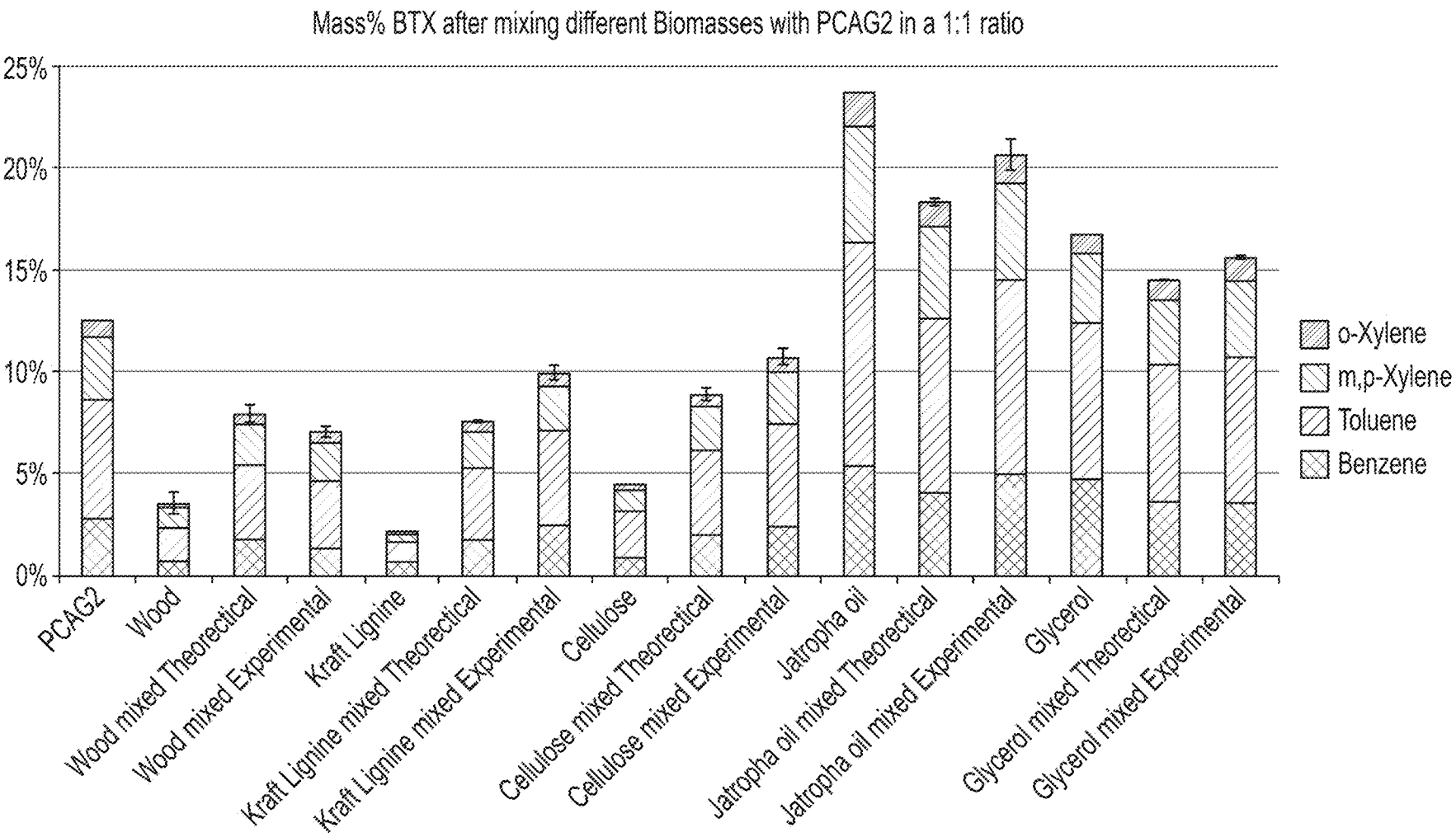

FIG. 12. shows the yields of BTX for the ex-situ pyrolysis of several biomass feedstocks co-feeded with a reduced polycyclic and polyaromatic hydrocarbon fraction (PCA, obtained from glycerol). It can be concluded that co-feeding of biomass with an already pyrolyzed fraction results in additional yields of BTX. Furthermore, in most cases a synergistic effect is observed as reflected by a higher yield of BTX from the mixtures than the sum of the yields from the individual feedstocks (see examples 7, 20 and 24-30)

Figure 13:
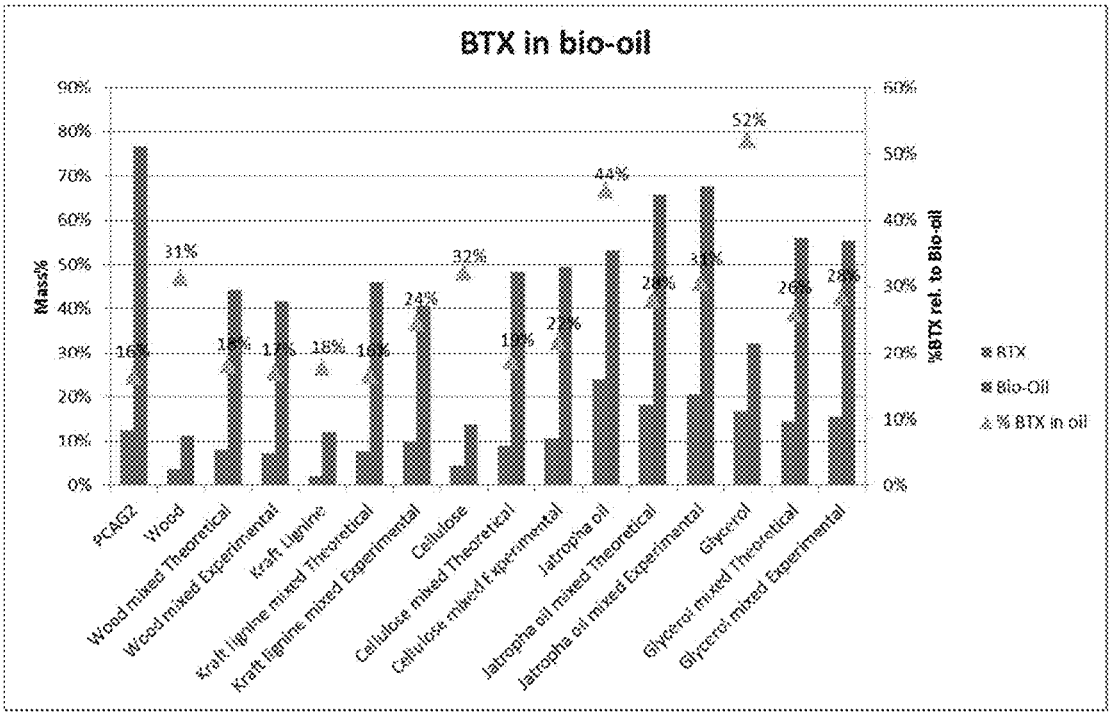

FIG. 13. The amount of BTX present in the bio-oil obtained after the ex-situ pyrolysis of several biomass feedstocks co-feeded with a reduced polycyclic and polyaromatic hydrocarbon fraction (PCA, obtained from glycerol) (see examples 7, 20 and 24-30).

TABLE 1

Products observed in the GC Chromatograms of polyaromatic hydrocarbons (from glycerol), polycyclic alkanes/polyaromatic hydrocarbons (PCA/PAH-1), obtained by catalytic hydrogenation (Ru/C) and PCA/PAH-1 aromatized over an H-ZSM-5 (23) catalyst

| RT | Quality | Glycerol over H-ZSM-5 (23) | PAH | PCA | PCA over H-ZSM-5 (23) |
|---|---|---|---|---|---|
| 6.06 | 94 | Benzene | | | Benzene |
| 8.3 | 90 | | | | Cyclohexane, 1,2-dimethyl-, tra |
| 9.87 | 91 | Toluene | | | Toluene |
| 11.54 | 94 | | | | Cyclohexane, 1,3,5-trimethyl-, |
| 12.86 | 91 | | | | Cyclohexane, 1,2,4-trimethyl- |
| 13.03 | 96 | | | Cyclohexane, 1,2,4-trimethyl- | Cyclohexane, 1,2,4-trimethyl- |
| 13.17 | 94 | | | | Cyclohexane, 1,2,4-trimethyl- |
| 13.39 | 95 | | | | cis-1-Ethyl-3-methyl-cyclohexan |
| 13.49 | 90 | | | | Cyclohexane, 1-ethyl-4-methyl-, |
| 14.47 | 93 | Ethylbenzene | | | Ethylbenzene |
| 14.94 | 97 | p-Xylene | | | Benzene, 1,3-dimethyl- |
| 15.72 | 91 | | | | Cyclohexane, 1-ethyl-2-methyl-, |
| 16.43 | 97 | Benzene, 1,2-dimethyl- | | | Benzene, 1,2-dimethyl- |
| 17.37 | 96 | | | 1H-Indene, octahydro-, trans- | 1H-Indene, octahydro-, trans- |
| 18.42 | 90 | | | | Cyclohexane, 1-methyl-2-propyl- |
| 19.02 | 95 | | Decane | Decane | |
| 19.11 | 91 | | | | Cyclohexane, diethyl- |
| 19.3 | 98 | | | 1H-Indene, octahydro-, cis- | 1H-Indene, octahydro-, cis- |
| 19.8 | 91 | Benzene, 1-ethyl-2-methyl- | | | |
| 19.82 | 90 | | Benzene, 1-ethyl-3-methyl- | | Benzene, 1-ethyl-3-methyl- |
| 19.87 | 90 | | Benzene, 1-ethyl-2-methyl- | | |
| 20.2 | 90 | Benzene, 1-ethyl-3-methyl- | | | |
| 20.21 | 96 | | | | 1,2,4-Trimethylbenzene |
| 20.61 | 95 | | | | Cyclohexane, 1-methyl-2-propyl- |
| 21 | 91 | | | | Benzene, 1,3,5-trimethyl- |
| 21.12 | 90 | | | Cyclohexane, butyl- | |
| 21.72 | 94 | Benzene, 1,2,3-trimethyl- | | | |
| 21.77 | 97 | | 1,2,4-Trimethylbenzene | 1,2,4-Trimethylbenzene | 1,2,4-Trimethylbenzene |
| 21.92 | 98 | | | 1H-Indene, octahydro-5-methyl- | 1H-Indene, octahydro-5-methyl- |
| 22.75 | 99 | | | Naphthalene, decahydro-, trans- | Naphthalene, decahydro-, trans- |
| 23.37 | 98 | | | 1H-Indene, octahydro-5-methyl- | 1H-Indene, octahydro-5-methyl- |
| 23.54 | 93 | | 1,2,4-Trimethylbenzene | Benzene, 1,2,3-trimethyl- | Benzene, 1,2,3-trimethyl- |
| 24.22 | 93 | | Indane | | Indane |
| 24.26 | 95 | | | Undecane | |
| 24.86 | 95 | | | | Benzene, 4-ethyl-1,2-dimethyl- |
| 25.25 | 99 | | | Naphthalene, decahydro- | Naphthalene, decahydro- |
| 25.55 | 95 | | | | Naphthalene, decahydro-2-methyl |

TABLE 1-continued

Products observed in the GC Chromatograms of polyaromatic hydrocarbons (from glycerol), polycyclic alkanes/polyaromatic hydrocarbons (PCA/PAH-1), obtained by catalytic hydrogenation (Ru/C) and PCA/PAH-1 aromatized over an H-ZSM-5 (23) catalyst

| RT | Quality | Glycerol over H-ZSM-5 (23) | PAH | PCA | PCA over H-ZSM-5 (23) |
|---|---|---|---|---|---|
| 25.67 | 94 | | Indene | | |
| 25.98 | 95 | | | | Benzene, 4-ethyl-1,2-dimethyl- |
| 26.08 | 91 | | | | Benzene, 1-methyl-4-(1-methylet |
| 26.35 | 94 | | | | Benzene, 2-ethenyl-1,4-dimethyl |
| 26.36 | 93 | | Benzene, 1-methyl-2-(2-propenyl)- | | |
| 26.43 | 90 | | Benzene, 1-ethyl-2,3-dimethyl- | | Benzene, 1-ethyl-2,3-dimethyl- |
| 26.44 | 90 | | | Benzene, 4-ethyl-1,2-dimethyl- | |
| 26.67 | 90 | | | | 2,3-Dihydro-1-methylindene |
| 27.65 | 94 | | | | Naphthalene, decahydro-2-methyl |
| 27.92 | 94 | | | | Naphthalene, decahydro-2-methyl |
| 28.15 | 93 | | Benzene, 1,2,4,5-tetramethyl- | | Benzene, 1,2,4,5-tetramethyl- |
| 28.16 | 91 | | | Benzene, 4-ethyl-1,2-dimethyl- | |
| 28.4 | 91 | | Benzene, 1,2,3,5-tetramethyl- | Benzene, 1,2,3,5-tetramethyl- | Benzene, 1,2,4,5-tetramethyl- |
| 29.18 | 95 | | Dodecane | Dodecane | |
| 29.38 | 93 | | | | 2,3-Dihydro-1-methylindene |
| 29.39 | 91 | | | Benzene, 2-ethenyl-1,4-dimethyl | |
| 30.14 | 96 | | | | Benzene, 2-ethenyl-1,4-dimethyl |
| 30.15 | 93 | | | 2,3-Dihydro-1-methylindene | |
| 30.73 | 96 | | 1H-Indene, 1-methyl- | | |
| 30.77 | 96 | | | Naphthalene, 1,2,3,4-tetrahydro | Naphthalene, 1,2,3,4-tetrahydro |
| 30.85 | 96 | | 1H-Indene, 1-methyl- | | |
| 31.28 | 92 | | | | Benzene, 2-ethenyl-1,3,5-trimet |
| 31.29 | 95 | | | 1H-Indene, 2,3-dihydro-4,7-dime | |
| 31.41 | 93 | | Benzene, (1-methyl-2-cyclopropen-l | | |
| 31.47 | 94 | | Benzene, (1-methyl-2-cyclopropen-1 | | |
| 31.54 | 91 | | | Naphthalene, 1,2,3,4-tetrahydro | |
| 31.54 | 94 | | | | Benzene, (2-methyl-1-butenyl)- |
| 31.8 | 95 | | | 1H-Indene, 2,3-dihydro-1,6-dime | 1H-Indene, 2,3-dihydro-4,7-dime |
| 32.01 | 91 | | | | 1H-Indene, 2,3-dihydro-1,2-dime |
| 32.24 | 94 | | | | Benzene, (2-methyl-1-butenyl)- |
| 32.25 | 91 | | | 1H-Indene, 2,3-dihydro-1,6-dime | |
| 33.24 | 96 | | | Naphthalene, 1,2,3,4-tetrahydro | Naphthalene, 1,2,3,4-tetrahydro |
| 33.52 | 94 | Naphthalene | | | |
| 33.55 | 94 | | Azulene | | Azulene |
| 33.64 | 94 | | | | Naphthalene, 1,2,3,4-tetrahydro |
| 33.79 | 91 | | | | Benzene, 1-(1-methylethenyl)-3- |
| 33.83 | 95 | | Tridecane | Tridecane | |
| 34.3 | 90 | | | | 1H-Indene, 2,3-dihydro-1,5,7-tr |
| 34.72 | 96 | | | | 1H-Indene, 2,3-dihydro-4,7-dime |

TABLE 1-continued

Products observed in the GC Chromatograms of polyaromatic hydrocarbons (from glycerol), polycyclic alkanes/polyaromatic hydrocarbons (PCA/PAH-1), obtained by catalytic hydrogenation (Ru/C) and PCA/PAH-1 aromatized over an H-ZSM-5 (23) catalyst

| RT | Quality | Glycerol over H-ZSM-5 (23) | PAH | PCA | PCA over H-ZSM-5 (23) |
|---|---|---|---|---|---|
| 34.73 | 90 | | | 1H-Indene, 2,3-dihydro-1,3-dime | |
| 35.53 | 94 | | | Naphthalene, 1,2,3,4-tetrahydro | Naphthalene, 1,2,3,4-tetrahydro |
| 36.18 | 91 | | | | Naphthalene, 1,2,3,4-tetrahydro |
| 36.25 | 90 | | | Benzene, pentamethyl- | Benzene, pentamethyl- |
| 36.54 | 90 | | | | 1H-Indene, 2,3-dihydro-4,5,7-tr |
| 36.66 | 93 | | 1H-Indene, 1,1-dimethyl- | | |
| 37.07 | 92 | | | Naphthalene, 1,2,3,4-tetrahydro | Naphthalene, 1,2,3,4-tetrahydro |
| 37.79 | 93 | | | Naphthalene, 1,2,3,4-tetrahydro | Naphthalene, 1,2,3,4-tetrahydro |
| 38.13 | 90 | | | Naphthalene, 1,2,3,4-tetrahydro | |
| 38.22 | 95 | | | Tetradecane | |
| 38.57 | 91 | Naphthalene, 1-methyl- | | | |
| 38.62 | 94 | | Naphthalene, 1-methyl- | | Naphthalene, 1-methyl- |
| 39.11 | 94 | | | l,4-Dimethyl-1,2,3,4-tetrahydro | 1,4-Dimethyl-1,2,3,4-tetrahydro |
| 39.23 | 95 | | | | 1,4-Dimethyl-1,2,3,4-tetrahydro |
| 39.38 | 94 | Naphtalene, 1-methyl | Naphthalene, 1-methyl- | | Naphthalene, 1-methyl- |
| 39.56 | 94 | | | Naphthalene, 6-ethyl-1,2,3,4-te | Naphthalene, 6-ethyl-1,2,3,4-te |
| 39.67 | 90 | | | Naphthalene, 1,2,3,4-tetrahydro | |
| 40.9 | 90 | | | | 3-Ethyl-3-phenyl-1-pentene |
| 41.09 | 90 | | Benzene, 1,3,5-trimethyl-2-(1,2-pr | | |
| 41.24 | 96 | | | Naphthalene, 1,2,3,4-tetrahydro | Naphthalene, 1,2,3,4-tetrahydro |
| 42.36 | 96 | | Pentadecane | Pentadecane | |
| 42.76 | 97 | | Naphthalene, 1-ethyl- | | |
| 43.21 | 95 | | | Naphthalene, 1,2,3,4-tetrahydro | Naphthalene, 1,2,3,4-tetrahydro |
| 43.26 | 94 | Naphthalene, 1,7-dimethyl- | | | |
| 43.3 | 98 | | Naphthalene, 2,6-dimethyl- | | |
| 43.3 | 96 | | | | Naphthalene, 1,7-dimethyl- |
| 43.31 | 91 | | | Naphthalene, 1,2,3,4-tetrahydro | |
| 43.91 | 93 | Naphthalene, 1,7-dimethyl- | | | |
| 43.95 | 98 | | Naphthalene, 1,8-dimethyl- | | |
| 43.95 | 98 | | | | Naphthalene, 2,6-dimethyl- |
| 44.04 | 91 | Naphthalene, 2,6-dimethyl- | | | |
| 44.08 | 97 | | Naphthalene, 2,6-dimethyl- | | Naphthalene, 2,6-dimethyl- |
| 44.98 | 96 | | Naphthalene, 1,3-dimethyl- | | Naphthalene, 1,3-dimethyl- |
| 45.58 | 90 | | Naphthalene, 1,2-dimethyl- | | |
| 47.17 | 91 | | Naphthalene, 1,4,6-trimethyl- | | Naphthalene, 1,4,6-trimethyl- |
| 48.14 | 93 | | Naphthalene, 1,6,7-trimethyl- | | Naphthalene, 1,6,7-trimethyl- |
| 48.3 | 95 | | Naphthalene, 1,6,7-trimethyl- | | Naphthalene, 1,6,7-trimethyl- |

TABLE 1-continued

Products observed in the GC Chromatograms of polyaromatic hydrocarbons (from glycerol), polycyclic alkanes/polyaromatic hydrocarbons (PCA/PAH-1), obtained by catalytic hydrogenation (Ru/C) and PCA/PAH-1 aromatized over an H-ZSM-5 (23) catalyst

| RT | Quality | Glycerol over H-ZSM-5 (23) | PAH | PCA | PCA over H-ZSM-5 (23) |
|---|---|---|---|---|---|
| 48.95 | 96 | | | | Naphthalene, 1,4,5-trimethyl- |
| 48.97 | 93 | | Naphthalene, 1,6,7-trimethyl- | | |
| 49.28 | 96 | | Naphthalene, 1,6,7-trimethyl- | | |
| 49.28 | 97 | | | | Naphthalene, 1,4,6-trimethyl- |
| 49.72 | 93 | | | | Naphthalene, 1,4,6-trimethyl- |
| 49.88 | 96 | | Naphthalene, 1,6,7-trimethyl- | | |
| 49.88 | 95 | | | | Naphthalene, 2,3,6-trimethyl- |
| 50.41 | 95 | | | | Naphthalene, 1,4,6-trimethyl- |
| 53.73 | 91 | | | | Azulene, 7-ethyl-1,4-dimethyl- |
| 54.24 | 94 | | | | Azulene, 7-ethyl-1,4-dimethyl- |
| 54.43 | 98 | | | Phenanthrene, 1,2,3,4,5,6,7,8-o | |
| 55.15 | 91 | | | | 4,4'-Dimethylbiphenyl |
| 55.4 | 93 | | | | 4,4'-Dimethylbiphenyl |
| 55.48 | 91 | | | | 4,4'-Dimethylbiphenyl |
| 56.54 | 91 | | | | Tricyclo[4.4.1.02, 5]undeca-1(10 |
| 67.31 | 91 | | | | Phenanthrene, 2,5-dimethyl- |

The invention is further illustrated by means of the following non-limiting examples.

EXPERIMENTAL SECTION

Example 1: Catalytic Aromatization of Glycerol (Ex Situ Upgrading, Gram Scale)

Crude glycerol was obtained from a biodiesel production process. The crude glycerol was first pyrolysed and subsequently in situ up-graded using a bench-scale reactor set up comprising a pyrolysis- and an up-grading unit, connected with each other. A constant stream of $N_2$ of about 11 min/ml was used as a gas flow in order to maintain an inert atmosphere. The pyrolysis unit was filled with crude glycerol (0.94 g) and the upgrading unit was filled with the catalyst (H-ZSM-5 (23), 3.18 g). The up-grading unit of the bench-scale reactor set up, including the catalyst, was first placed in a fluidized sand bed (T=550° C.) and after reaching T=550° C. the pyrolysis unit, comprising the crude glycerol, was placed in the fluidizing bed to start the vaporization/pyrolysis. The pyrolysis took about 5-15 min to finish (constant $N_2$ flow). The obtained glycerol liquor gas is subsequently converted in the upgrading unit via the catalytic treatment. The converted glycerol liquor gas was subsequently condensed by cooling the vapour phase to a temperature of −40° C. The amount of condensables was determined by weight. The cooling unit was then washed with small amounts of THF, the amount of water was determined using Karl Fischer titration and the organic fraction was subsequently calculated by difference.

Example 2: Catalytic Aromatization of Glycerol (Ex Situ Upgrading, >100 Gram Scale)

Crude glycerol was evaporated/pyrolyzed/aromatized in a demo reactor comprising a evaporation/pyrolysis unit (reactor 1, T=520° C.), a fixed bed containing the aromatization catalyst (reactor 2, H-ZSM-5 (23)/bentonite 60:40, 200 gram, 1-2 mm particles, T=536° C.) and a condenser zone (T=−20° C.). The glycerol was heated to T=70° C. and fed (850 gram, 3.8 g/min) to the first reactor using a $N_2$ flow (1.5 L/min). Layer separation of the condensed fraction (organics/water) afforded an aromatic oil (163.2 g; about 70 g BTX, based on GC)) and water (215.45 g).

Example 3: Distillation of the Aromatic Oil

Combined crude aromatic bio-oils (3.5 liter) from example 2 were transferred to a separating funnel and the phases were allowed to settle over the weekend. The phases were separated and the crude bio-oil was dried over $Na_2SO_4$ and subsequently filtered by suction over a glass-filter. The filtered oil (2941 g) was subjected to a coarse distillation under reduced pressure (1000 mbar® 50 mbar and 40° C.® 110° C. using a simple distilling setup and a 3-4 L distilling flask, affording a mixture of benzene, toluene and xylenes (1193 g) and a residual oil (1748 g) consisting of higher molecular weight aromatics (polyaromatic hydrocarbons)

Example 4: Catalytic Hydrogenation of Substituted Polyaromatic Hydrocarbons (PAH-1)

A polyaromatic hydrocarbon fraction, obtained according to Example 3 (PAHG1; 15.02 g), and 5% Ru/C (0.76 g; Sigma-Aldrich) were put under hydrogen pressure (101.5 bar) in a Parr apparatus and heated to 305° C. (external temperature, P=119.1 bar). A gradual pressure drop in $H_2$ pressure was observed. After stirring for 2 hrs the reaction was cooled to room temperature and the reaction product was filtered over cotton wool (3×) and $Na_2SO_4$ (1×), affording an orange oil (5 g).

Example 5: Catalytic Hydrogenation of Substituted Polyaromatic Hydrocarbons (PAH-2))

A polyaromatic hydrocarbon fraction, obtained according to Example 3 (PAHG2; 18.01 g), and 5% Ru/C (0.92 g) were put under hydrogen pressure (134.1 bar) in a Parr apparatus and heated to 305° C. (external temperature, P=119.1 bar). A gradual pressure drop in $H_2$ pressure was observed. After stirring for 3.25 hrs the reaction was cooled to room temperature and the reaction product was filtered over Whatman syringe filters (0.2 μm) affording an orange oil (11.6 g).

Example 6: Catalytic Aromatization of Substituted Polyaromatic Hydrocarbons (Ex Situ Upgrading, PAH2, Gram Scale)

Under identical conditions as described in Example 1 a substituted polyaromatic fraction (prepared according to Example 3, 1.05 gram) was ex-situ pyrolyzed with a H-ZSM-5 (23) catalyst (3.04 g).

Example 7: Catalytic Aromatization of Substituted Polycyclic Aliphatic Hydrocarbons/Polyaromatic Hydrocarbons (Ex Situ Upgrading, PCA-2, Gram Scale)

Under identical conditions as described in Example 1 a reduced polyaromatic hydrocarbon fraction (PCAG2, prepared according to Example 5, 0.87 g) was ex-situ pyrolyzed with a H-ZSM-5 (23) catalyst (3.01 g).

Example 8: Integrated Cascading Catalytic Pyrolysis of a Reduced Polyaromatic Hydrocarbon Fraction (PCAG2) with Bentonite (Ex Situ Upgrading, Gram Scale)

Under identical conditions as described in Example 1 a reduced polyaromatic hydrocarbon fraction (PCAG2, according to Example 5, 0.52 g) mixed with bentonite (0.54 g) was ex-situ pyrolyzed with a H-ZSM-5 (23) catalyst (1.55 g).

Example 9: Integrated Cascading Catalytic Pyrolysis of a Reduced Polyaromatic Hydrocarbon Fraction (PCAG2) with Hydrotalcite (Ex Situ Upgrading, Gram Scale)

Under identical conditions as described in Example 1 a reduced polyaromatic hydrocarbon fraction (PCAG2, according to Example 5, 0.57 g) mixed with hydrotalcite (0.48 g) was ex-situ pyrolyzed with a H-ZSM-5 (23) catalyst (2.09 g).

Example 10: Integrated Cascading Catalytic Pyrolysis of a Reduced Polyaromatic Hydrocarbon Fraction (PCAG2) with Phosphotungstic Acid Hydrate (Ex Situ Upgrading, Gram Scale)

Under identical conditions as described in Example 1 a reduced polyaromatic hydrocarbon fraction (PCAG2, according to Example 5, 0.52 g) mixed with phosphotungstic acid hydrate (0.25 g) was ex-situ pyrolyzed with a H-ZSM-5 (23) catalyst (1.59 g).

Example 11: Integrated Cascading Catalytic Pyrolysis of a Reduced Polyaromatic Hydrocarbon Fraction (PCAG2) with $MnO_2$ (Ex Situ Upgrading, Gram Scale)

Under identical conditions as described in Example 1 a reduced polyaromatic hydrocarbon fraction (PCAG2, according to Example 5, 0.51 g) mixed with $MnO_2$ (0.27 g) was ex-situ pyrolyzed with a H-ZSM-5 (23) catalyst (1.64 g).

Example 12: Integrated Cascading Catalytic Pyrolysis of a Reduced Polyaromatic Hydrocarbon Fraction (PCAG2) with FeO (Ex Situ Upgrading, Gram Scale)

Under identical conditions as described in Example 1 a reduced polyaromatic hydrocarbon fraction (PCAG2, according to Example 5, 0.48 g) mixed with FeO (0.28 g) was ex-situ pyrolyzed with a H-ZSM-5 (23) catalyst (1.87 g).

Example 13: Integrated Cascading Catalytic Pyrolysis of a Reduced Polyaromatic Hydrocarbon Fraction (PCAG2) with Silicotungstic Acid (Ex Situ Upgrading, Gram Scale)

Under identical conditions as described in Example 1 a reduced polyaromatic hydrocarbon fraction (PCAG2, according to Example 5, 0.47 g) mixed with silicotungstic acid (0.33 g) was ex-situ pyrolyzed with a H-ZSM-5 (23) catalyst (1.71 g).

Example 14: Integrated Cascading Catalytic Pyrolysis of a Reduced Polyaromatic Hydrocarbon Fraction (PCAG2) with ASA1/Siral 40 (Ex Situ Upgrading, Gram Scale)

Under identical conditions as described in Example 1 a reduced polyaromatic hydrocarbon fraction (PCAG2, according to Example 5, 0.45 g) mixed with ASA1/Siral 40 (0.49 g) was ex-situ pyrolyzed with a H-ZSM-5 (23) catalyst (1.74 g).

Example 15: Catalytic Aromatization of Substituted Polycyclic Aliphatic Hydrocarbons/Polyaromatic Hydrocarbons (Ex Situ Upgrading, PCA-2, Gram Scale, Fresh Material)

Under identical conditions as described in Example 1 a reduced polyaromatic hydrocarbon fraction (PCAG2, fresh material, prepared according to Example 5, 0.99 g) was ex-situ pyrolyzed with a H-ZSM-5 (23) catalyst (3.05 g).

Example 16: Integrated Cascading Catalytic Pyrolysis of a Reduced Polyaromatic Hydrocarbon Fraction (PCAG2, Fresh Material)) with FeO (Ex Situ Upgrading, Gram Scale)

Under identical conditions as described in Example 1 a polyaromatic hydrocarbon fraction (according to Example 5, Inouk 0.87 g) mixed with FeO (0.35 g) was ex-situ pyrolyzed with a H-ZSM-5 (23) catalyst (3.03 g).

Example 17: Ex Situ Pyrolysis of a Reduced Polyaromatic Hydrocarbon Fraction with $FeO_2$/H-ZSM-5 (23), Layered Under identical conditions as described in Example 1 a polyaromatic hydrocarbon fraction (according to Example 5, 0.86 g) was pyrolyzed and catalytically aromatized with a catalyst consisting of FeO (first layer, 0.71 g) and H-ZSM-5 (23) (second layer, 3.15 g)

Example 18: Integrated Cascading Catalytic Pyrolysis of a Reduced Polyaromatic Hydrocarbon Fraction (PCAG2, Fresh Material) with ASA1/Siral 40 (Ex Situ Upgrading, Gram Scale)

Under identical conditions as described in Example 1 a polyaromatic hydrocarbon fraction (according to Example 5, 1.10 g) mixed with ASA1/Siral 40 (Inouk 0.77 g) was ex-situ pyrolyzed with a H-ZSM-5 (23) catalyst (3.63 g).

Example 19: Ex Situ Pyrolysis of a Reduced Polyaromatic Hydrocarbon Fraction (PCAG2, Fresh Material) with ASA1/Siral 40/H-ZSM-5 (23), Layered Under identical conditions as described in Example 1 a polyaromatic hydrocarbon fraction (according to Example 5, 1.02 g) was pyrolyzed and catalytically aromatized with a catalyst consisting of ASA1/Siral 40 (first layer, 0.70 g) and H-ZSM-5 (23) (second layer, 3.40 g)

Example 20: Catalytic Aromatization of Wood (Ex Situ Upgrading, Gram Scale)

Under identical conditions as described in Example 1 pinewood (0.85 g) was ex-situ pyrolyzed with a H-ZSM-5 (23) catalyst (2.63 g).

Example 21: Catalytic Aromatization of a Mixture of Pinewood and Substituted Polyaromatic Hydrocarbons (Hydrocarbons (PAH-2), Ratio 1:1 (Ex Situ Upgrading, Gram Scale)

Under identical conditions as described in Example 1 a polyaromatic hydrocarbon fraction (PAH-2, according to Example 3, 0.62 g) mixed with pinewood (0.56 g) was ex-situ pyrolyzed with a H-ZSM-5 (23) catalyst (3.64 g).

Example 22: Catalytic Aromatization of a Mixture of Glycerol and Substituted Polyaromatic Hydrocarbons (Hydrocarbons (PAH-2), Ratio 1:1 (Ex Situ Upgrading, Gram Scale)

Under identical conditions as described in Example 1 a polyaromatic hydrocarbon fraction (according to Example 3, 0.57 g) mixed with glycerol (0.40 g) was ex-situ pyrolyzed with a H-ZSM-5 (23) catalyst (3.29 g).

Example 23: Catalytic Aromatization of a Mixture of Glycerol and a Reduced Polyaromatic Hydrocarbon Fraction (Hydrocarbons (PCAG-2), Ratio 1:1 (Ex Situ Upgrading, Gram Scale)

Under identical conditions as described in Example 1 a reduced polyaromatic hydrocarbon fraction (according to Example 5, 0.43 g) mixed with glycerol (0.40 g) was ex-situ pyrolyzed with a H-ZSM-5 (23) catalyst (3.17 g).

Example 24: Catalytic Aromatization of a Mixture of Wood and a Reduced Polyaromatic Hydrocarbon Fraction (PCAG2), Ratio 1:1 (Ex Situ Upgrading, Gram Scale)

Under identical conditions as described in Example 1 a reduced polyaromatic hydrocarbon fraction (prepared according to Example 5, 0.61 g) mixed with wood (0.50 g) was ex-situ pyrolyzed with a H-ZSM-5 (23) catalyst (3.33 g).

Example 25: Catalytic Aromatization of Kraft Lignin (Ex Situ Upgrading, Gram Scale)

Under identical conditions as described in Example 1 Kraft lignin (1.00 g) was ex-situ pyrolyzed with a H-ZSM-5 (23) catalyst (3.37 g).

Example 26: Catalytic Aromatization of a Mixture of Kraft Lignin and a Reduced Polyaromatic Hydrocarbon Fraction (PCAG2), Ratio 1:1 (Ex Situ Upgrading, Gram Scale)

Under identical conditions as described in Example 1 a reduced polyaromatic hydrocarbon fraction (prepared according to Example 5, 0.55 g) mixed with Kraft lignin (0.51 g) was ex-situ pyrolyzed with a H-ZSM-5 (23) catalyst (3.29 g).

Example 27: Catalytic Aromatization of Cellulose (Ex Situ Upgrading, Gram Scale)

Under identical conditions as described in Example 1 cellulose (1.00 g) was ex-situ pyrolyzed with a H-ZSM-5 (23) catalyst (2.96 g).

Example 28: Catalytic Aromatization of a Mixture of Cellulose and a Reduced Polyaromatic Hydrocarbon Fraction (PCAG2), Ratio 1:1 (Ex Situ Upgrading, Gram Scale)

Under identical conditions as described in Example 1 a reduced polyaromatic hydrocarbon fraction (prepared according to Example 5, 0.53 g) mixed with cellulose (0.53 g) was ex-situ pyrolyzed with a H-ZSM-5 (23) catalyst (3.79 g).

Example 29: Catalytic Aromatization of Jatropha Oil (In Situ Upgrading, Gram Scale)

Under identical conditions as described in Example 1 Jatropha oil (1.28 g) was ex-situ pyrolyzed with a H-ZSM-5 (23) catalyst (3.87 g).

Example 30: Catalytic Aromatization of a Mixture of Jatropha Oil and a Reduced Polyaromatic Hydrocarbon Fraction (PCAG2), Ratio 1:1 (Ex Situ Upgrading, Gram Scale)

Under identical conditions as described in Example 1 a reduced polyaromatic hydrocarbon fraction (prepared according to Example 5, 0.51 g) mixed with Jatropha oil (0.52 g) was ex-situ pyrolyzed with a H-ZSM-5 (23) catalyst (3.79 g).

The invention claimed is:

1. A process for the preparation of aromatic compounds from a feed stream containing biomass or mixtures of biomass, the process comprising:

a) subjecting a feed stream containing biomass or mixtures of biomass to a process comprising catalytic pyrolysis to afford a conversion product comprising aromatic compounds comprising a higher molecular weight fraction comprising polyaromatic hydrocarbons (PAH) and a lower molecular weight fraction comprising benzyne, toluene and xylene (BTX);

b) recovering the aromatic compounds from said conversion product;

c) separating said higher molecular weight fraction comprising PAH from said lower molecular weight fraction comprising BTX by distillation;

d) reducing at least part of said higher molecular weight fraction to obtain a reduced fraction comprising polycyclic aliphatics (PCA); and e) subjecting the higher molecular weight fraction obtained in step c), the reduced fraction obtained in step d), or a mixture thereof, to a process comprising catalytic pyrolysis to obtain lower molecular weight aromatics (BTX).

2. Process according to claim 1, wherein the catalytic pyrolysis of step a) and/or step e) comprises using a cracking catalyst, followed by subsequently subjecting the vapors thus obtained to an ex situ catalytic aromatization step.

3. Process according to claim 1, wherein said feed stream containing biomass or mixtures of biomass comprises one or more materials selected from the group consisting of agricultural waste, plants, wood, glucose, maltose, starch, cellobiose, cellulose, hemi-cellulose, other polysaccharides, lignin, sugar cane bagasse, lignocellulosic materials, wood chips, wood shaving lignocellulosic biomass, glycerol, fatty acids, fatty acid methyl esters, triglycerides, food waste, animal waste, manure, corn stover, partially decayed vegetation, peat, lignite, and combinations thereof.

4. Process according to claim 1, wherein step a) comprises adding at least one further reactant to the feed stream, the reactant being selected from the group consisting of olefins, alcohols, aldehydes, ketones, acids and combinations thereof.

5. Process according to claim 4, wherein the further reactant comprises 1 to 6 carbon atoms.

6. Process according to claim 1, wherein step d) comprises catalytic hydrogenation.

7. Process according to claim 5, wherein the further reactant is selected from the group consisting of ethene, propene, butene, isobutene, pentenes, hexenes, methanol, ethanol, propanol, isopropanol, hexanol, formaldehyde, acetaldehyde, acetone, methyl ethyl ketone, formic acid and acetic acid.

8. Process according to claim 6, wherein said catalytic hydrogenation comprises using a catalyst selected from the group consisting of Ru/C, Ni/C, Pd/C, Pt/C, $MoS_2$, $WS_2$, Co—Mo—S/$Al_2O_3$, Ni—Mo—S/$Al_2O_3$, Ni—W—S/$Al_2O_3$, Co—Mo/$Al_2O_3$, the Wilkinson catalyst and the Crabtree catalyst.

9. Process according to claim 6, wherein said catalytic hydrogenation is performed without the addition of a solvent.

10. Process according to claim 1, wherein step e) comprises mixing the higher molecular weight fraction obtained in step c), the reduced fraction obtained in step d), or a mixture thereof, with a biomass feedstream and subjecting the resulting mixture to catalytic pyrolysis treatment.

11. Process according to claim 10, comprising mixing the higher molecular weight fraction obtained in step c), the reduced fraction obtained in step d), or a mixture thereof, with the biomass feedstream of step a).

12. A composition comprising higher molecular weight polyaromatic hydrocarbons (PAH) obtainable by steps a) through c) of claim 1.

13. A composition comprising higher molecular weight polycyclic aliphatics (PCA) obtainable by steps a) through d) of claim 1.

14. Composition according to claim 13, comprising up to 10 wt % of monocyclic compounds.

15. Composition according to claim 13, wherein said composition comprises a mixture of polycyclic aliphatics (PCA) and polyaromatic hydrocarbons (PAH).

16. Composition according to claim 13, wherein said composition comprises compounds having a molecular weight in the range of about 100 to 500 Daltons.

17. Composition according to claim 12, wherein said composition comprises compounds having about 9 to 20 C-atoms and multiple aromatic rings.

18. Composition according to claim 12, being a biofuel.

19. Composition according to claim 13, being a jet fuel additive.

20. Composition according to claim 16, wherein said compounds have a molecular weight range of about 120 to 300 Daltons.

* * * * *